US008020399B2

(12) United States Patent
Hall, III

(10) Patent No.: US 8,020,399 B2
(45) Date of Patent: Sep. 20, 2011

(54) HIGH PRESSURE MISTER FAN COOLING SYSTEM

(75) Inventor: John Edward Hall, III, The Colony, TX (US)

(73) Assignee: T&B Financial Services, Inc., Sudan, TX (US)

( * ) Notice: Subject to any disclaimer, the term of this patent is extended or adjusted under 35 U.S.C. 154(b) by 258 days.

(21) Appl. No.: 11/736,172

(22) Filed: Apr. 17, 2007

(65) Prior Publication Data

US 2008/0256969 A1 Oct. 23, 2008

(51) Int. Cl.

| | |
|---|---|
| ***F25D 23/12*** | (2006.01) |
| ***F28D 5/00*** | (2006.01) |
| ***F04B 23/08*** | (2006.01) |
| ***F04B 49/00*** | (2006.01) |

(52) U.S. Cl. ... 62/259.4; 62/314; 417/199.1; 417/199.2; 417/307

(58) Field of Classification Search ..... 62/314, 62/259.4; 417/199.1, 221, 199.2, 307; 239/93; 261/25, 28, 30, 49, 58, 67, 84, 116, DIG. 3, 261/DIG. 43

See application file for complete search history.

(56) References Cited

U.S. PATENT DOCUMENTS

| | | | | |
|---|---|---|---|---|
| 3,682,565 | A * | 8/1972 | Yarger | 417/270 |
| 3,975,116 | A * | 8/1976 | Feild et al. | 417/311 |
| 3,997,115 | A | 12/1976 | Licudine | |
| 5,823,091 | A * | 10/1998 | Collingborn | 92/59 |
| 6,053,709 | A * | 4/2000 | Reavis | 417/401 |
| 6,086,053 | A | 7/2000 | Natschke et al. | |
| 6,450,778 | B1 * | 9/2002 | Spoolstra et al. | 417/307 |
| 6,786,701 | B1 * | 9/2004 | Huang et al. | 417/199.1 |
| 6,789,787 | B2 | 9/2004 | Stutts | |
| 6,796,136 | B1 | 9/2004 | Sullivan et al. | |
| 6,883,251 | B2 | 4/2005 | Terrell et al. | |
| 6,886,759 | B1 | 5/2005 | Okronick et al. | |
| 2001/0012486 | A1 * | 8/2001 | Breuer et al. | 417/307 |

* cited by examiner

*Primary Examiner* — Filip Zec
(74) *Attorney, Agent, or Firm* — Susanne M. Moore

(57) ABSTRACT

A high pressure mister cooling system having an electric fan, a high pressure pump mounted on the fan, an eccentric on the fan motor shaft, and mister nozzles mounted on the fan guard. A pump shaft is reciprocated by the eccentric when the fan is operated. A pump body includes a pump piston and bore, an inlet valve that opens when supply pressure exceeds 20 psi, a pump outlet valve that opens when pump pressure exceeds 120 pounds, and a pressure limiting valve that opens when pump pressure exceeds 1000 pounds. Water flows only when an inlet supply is attached and the fan is operating, and outlet pressure to the mister nozzles is controlled at about 1000 psi.

11 Claims, 5 Drawing Sheets

HIGH PRESSURE MISTER FAN COOLING SYSTEM

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

The present invention relates to cooling systems, and more particularly to a cooling system of the mister type in which high pressure water is atomized by a misting nozzle and evaporated by forced air flow.

BACKGROUND OF THE INVENTION

Various systems rely on evaporating water to provide cooling. For example, evaporative coolers, commonly referred to as swamp coolers, have been used for years to cool houses. These coolers drive air through a water soaked pad and the air is cooled as the water evaporates.

Fans have been fitted with nozzles to spray a mist of water into the air stream produced by the fan, and are commonly referred to as mister cooling systems. Such systems are often seen at sporting events. The moving air is cooled by evaporation of the mist carried in the air stream. For mister systems to be efficient, it is necessary to atomize the water, i.e. reduce the water to minute particles or droplets, producing the largest surface area possible and the quickest evaporation rate. This has required large, high pressure pumps to provide a flow of water at greater than eight hundred pounds per square inch, psi, to mister nozzles. Powerful motors have been used to drive the pumps. The systems are relatively heavy and expensive.

SUMMARY OF THE INVENTION

A high pressure mister cooling system comprises a motor driven fan, a high pressure pump mounted on the fan, an eccentric on the fan motor shaft, and mister nozzles mounted on the fan guard. A pump shaft is reciprocated by the eccentric when the fan is operated.

In an embodiment, the pump comprises a pump body having a bore and a pump piston carried in the bore.

In an embodiment, the pump body includes an inlet valve that opens when supply pressure exceeds internal pump pressure by a preselected value.

In an embodiment, the pump body includes a pump outlet valve that opens when pump pressure exceeds a preselected value.

In an embodiment, the pump body includes a pressure limiting valve that opens when pump pressure exceeds a preselected value.

In an embodiment, the present invention comprises a kit and method for providing mister cooling functionality to an otherwise conventional fan.

DETAILED DESCRIPTION OF THE PREFERRED EMBODIMENTS

True mister cooling systems depend on flash evaporation of water to provide essentially instant cooling. To produce flash evaporation, it is necessary to provide water at a pressure of at least 800 psi, and preferably about 1000 psi. The high pressure water may be driven through mister nozzles having small diameter, e.g. about 0.008 inch, to atomize the water producing droplets having a diameter on the order of five microns and therefore having a very large surface area to promote evaporation. Such small water droplets can reduce the temperature of an air stream by 25° to 40° F., degrees Fahrenheit, within about two feet of a fan. While it would seem that increased pressure would increase the atomization of the water, i.e. produce smaller droplets, more surface area, and better cooling effect, it has been found that pressure above 1500 psi does not significantly improve performance. This embodiment was designed to provide a pressure of from about 800 psi to 1500 psi with a nominal pressure of 1000 psi which has been found to produce good cooling.

In the disclosed embodiments, a small lightweight pump is mechanically coupled to a generally conventional electric motor fan and is driven by the output shaft of the same electric motor that drives a fan blade. Despite its small size and light weight, the pump pressurizes a water stream to about 1000 psi for driving one or more mister nozzles carried on a fan guard in the path of air driven by the fan blades. The pump may provide a flow of about 0.06 gallons of water per minute, which is sufficient for one fan.

Figure 1:
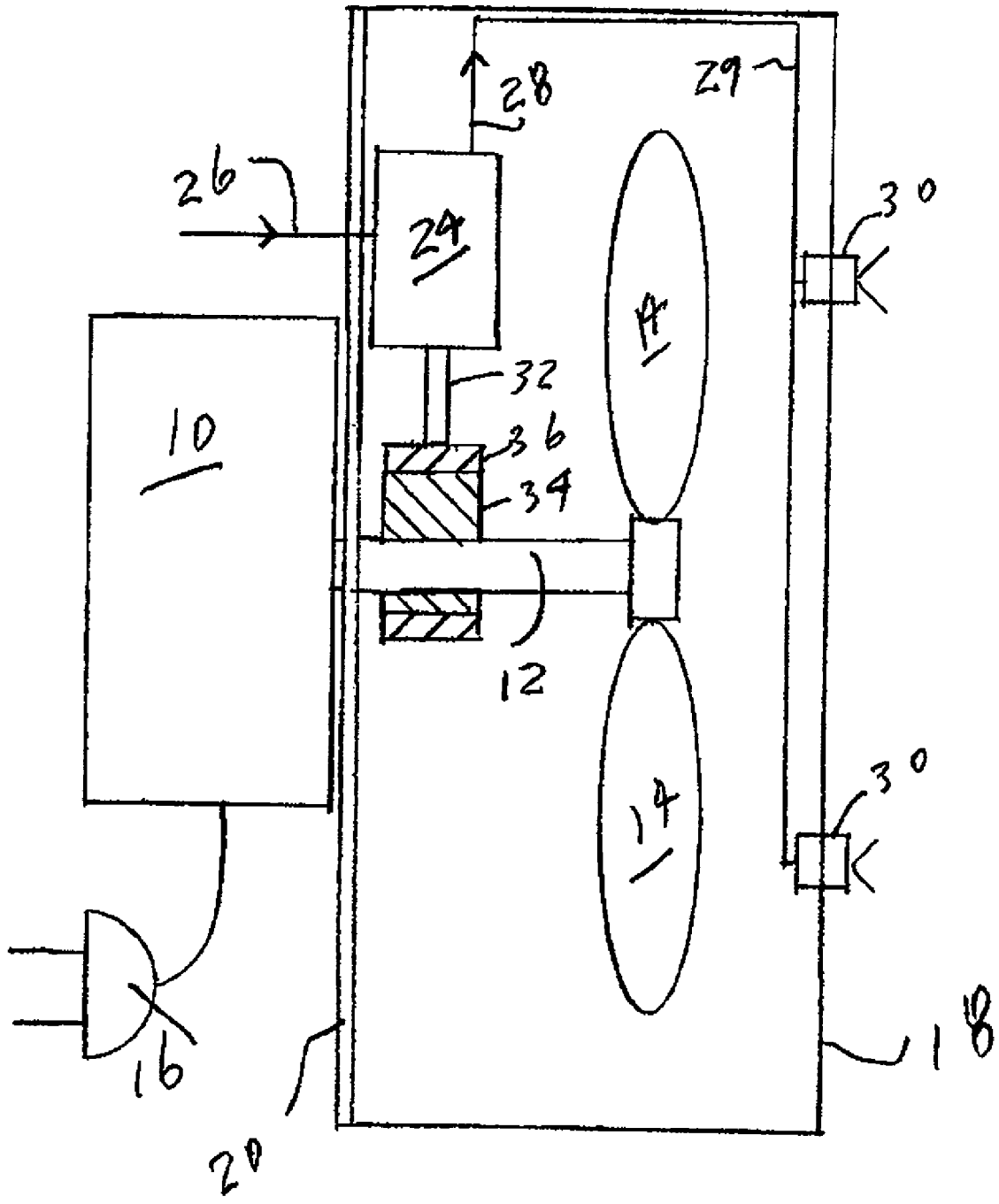
FIG. 1 is a partially schematic drawing of an embodiment comprising an electric fan combined with a high pressure mister pump driven by the fan motor and mister nozzles.

With reference to FIG. 1, an embodiment will be described. A generally conventional electric fan includes an electric motor 10, having an output shaft 12 on which are mounted fan blades 14. The fan motor 10 may be powered by conventional 120 volt, sixty hertz electrical power through a conventional plug 16. Such fans normally include a safety guard 18 which may be connected to the fan motor 10 by a frame 20. Conventional fans include some form of supporting stand or wall mounting which is not shown. In other embodiments the fan motor 10 could operate on other voltages such as 220 volt, sixty hertz electrical power, 12 volt DC power, etc. The shaft 12 could be driven by a fuel powered engine instead of an electric motor.

In the disclosed embodiment, a small high pressure mister pump 24 is also mounted on the frame 20. The pump 24 has a water inlet 26 which is adapted for connection to a conventional household water supply which typically operates at 30 to 90 psi. A pump 24 output 28 provides a supply of high pressure water through tubing 29 to mister nozzles 30, which in this embodiment are mounted on the safety guard 18 and positioned in the flow of air produced by blades 14.

In this embodiment, the pump 24 has a pump shaft 32 driven by the shaft 12 of the motor 10. An eccentric 34 is attached to the fan shaft 12 and rotates with the shaft 12. The eccentric 34 is essentially a solid cylinder having bore offset from center and sized to fit on shaft 12 and may be connected by splines on the shaft 12, by a key, or by a set screw as desired. In this embodiment, the eccentric bore may be offset by 0.10 inch, to provide a pump stroke of 0.20 inch. Carried on the outer surface of eccentric 34 is a bearing 36, which is preferable a sealed roller or pin bearing, but may be a ball bearing if desired. The bearing 36 may have the same width as the eccentric 34, but should be at least as wide as the diameter of pump shaft 32. The system would work without the bearing 36 if sufficient lubrication could be provided for a sliding contact between the pump shaft 32 and the eccentric 34 without wearing the shaft 32 and/or the eccentric 34. In practice it is preferred to use the bearing 36 with sealed lubrication.

Figure 2:
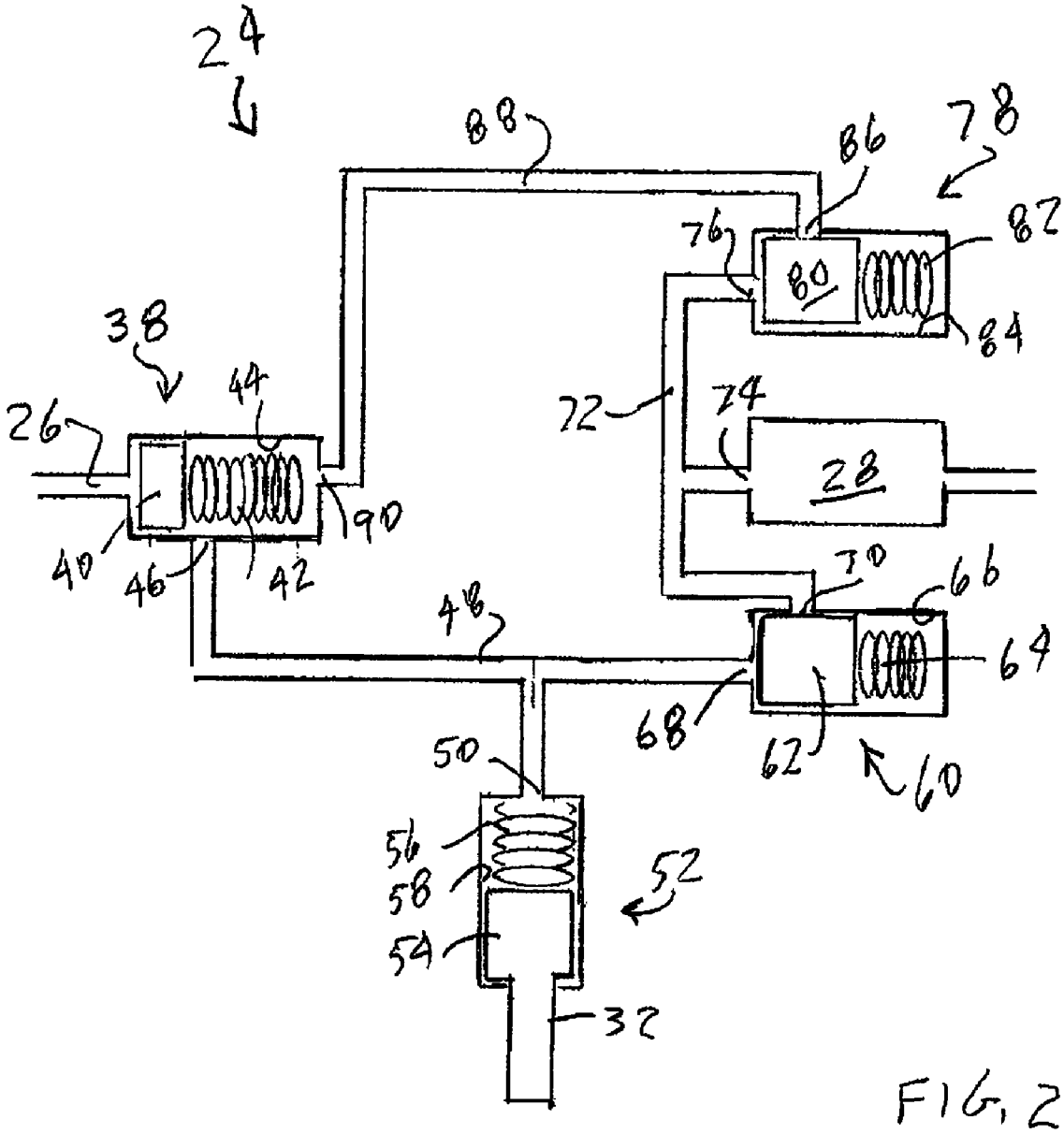
FIG. 2 is a schematic diagram of an embodiment of a mister pump.

With reference to FIG. 2, the functional elements of the mister pump will be described. Structural details are described below with reference to FIGS. 3 through 6. The low pressure water inlet 26 is connected to a low pressure inlet valve 38. The valve 38 includes a piston 40 and spring 42 carried in a bore 44. An outlet 46 is isolated from the inlet 26 by the piston 40 in the rest position shown in FIG. 2. The spring constant of spring 42 and the diameter of piston 38 are selected so that at a pressure of about 20 psi across the piston 38, the piston 38 will compress spring 42 and move sufficiently to open the outlet 46 and allow inlet water to flow through outlet 46 and into flow path 48.

Flow path 48 is connected to an inlet/outlet 50 of a pump 52. The pump 52 includes a piston 54 and spring 56 carried within a bore 58. The pump shaft 32 is connected to, and may be an integral part of, the piston 54. As shown in FIG. 1, the pump shaft 32 rides on the eccentric 34 and bearing 36, so that it and piston 54 reciprocate, i.e. move up and down, when the fan shaft 12 rotates. As the piston 54 moves down, it draws water from inlet 26, through inlet valve 38, flow path 48, and inlet/outlet 50 into the bore 58. The spring 56 and the inlet 26 water pressure provide force to move the piston 54 down and keep it in contact with the bearing 36 on the down stroke. When the piston 54 moves upward, the pump 52 drives water back into the flow path 48.

Flow path 48 is also connected to the inlet 68 of a middle pressure relief valve 60. The valve 60 includes a piston 62 and spring 64 carried in a bore 66. The spring constant of spring 64 and the diameter of piston 62 are selected so that at an inlet pressure of about 120 psi, the piston 62 will move sufficiently to open an outlet 70 and allow water to flow from flow path 48 into a flow path 72.

The flow path 72 is connected to the outlet 28 through which pressurized water is supplied to the nozzles 30 shown in FIG. 1.

The flow path 72 is also connected to an inlet 76 of a high pressure relief valve 78. The valve 78 includes a piston 80 and spring 82 carried in a bore 84. The spring constant of spring 82 and the diameter of piston 80 are selected so that at an inlet pressure of about 1000 psi, the piston 80 will move sufficiently to open an outlet 86 and allow water to flow from flow path 72 into a flow path 88.

The flow path 88 is also connected to a second inlet 90 of the low pressure inlet valve 38. The inlet 90 is positioned on the spring end of valve 38, that is, on the side of piston 40 opposite from the side exposed to the low pressure water inlet 26.

Figure 3:
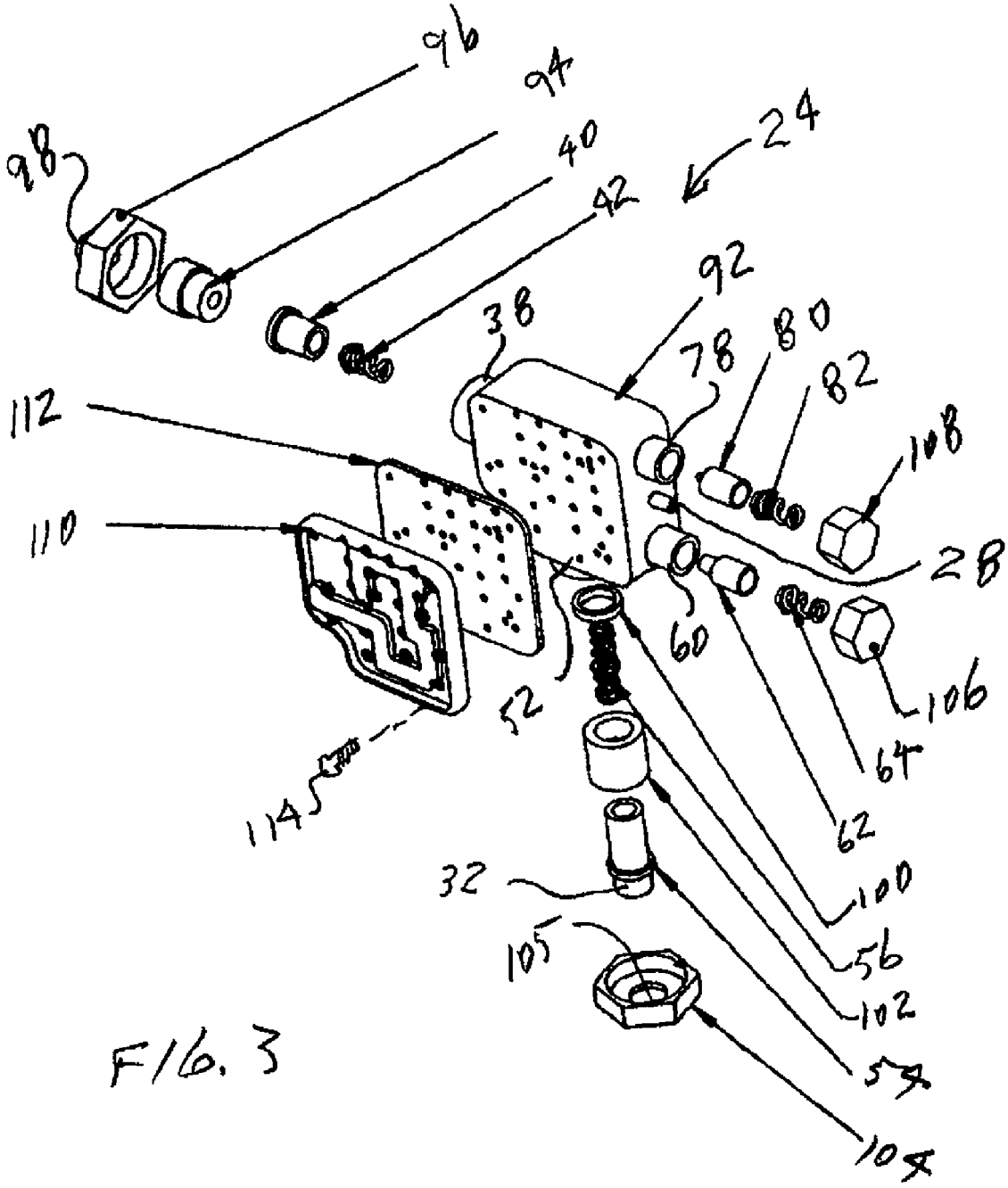
FIG. 3 is an exploded perspective assembly diagram of an embodiment of a mister pump.

FIG. 3 is a perspective exploded assembly view of an embodiment of a pump 24. In FIG. 3, reference numbers used to identify elements in FIGS. 1 and 2 are also used to identify the same or equivalent parts. The largest single part of pump 24 is a pump body 92, shown in more detail in FIGS. 4 and 5. The valve and pump bores 44, 58, 66 and 84 are formed within the pump body 92, preferably as part of an injection molding process. The inlet valve 38 is assembled by inserting the spring 42 followed by the piston 40 into the bore 44. A bushing 94 in then inserted in the bore 44 and a cap 96 is screwed onto the valve 38 to retain all parts within the bore 44. A screw fitting 98 is provided on the cap 98 for connection of a low pressure water supply line.

The pump 52 is assembled by inserting a seal 100, the spring 56, a seal/bushing 102, and the pump piston 54 into the bore 58, in that order. A cap 104 is then screwed onto the pump 52 to retain the internal parts. The cap 104 includes an opening 105 through which the pump shaft 32 passes for contact with the eccentric 34 and bearing 36, as shown in FIG. 1.

Middle pressure valve 60 is assembled by inserting piston 62 and spring 64 into the bore 66. A cap 106 is then screwed onto the valve 60 to retain the internal parts.

The outlet 28 has no internal parts. It simply provides a threaded fitting for connection to the high pressure flow line 29 connected to the nozzles 30.

High pressure valve 78 is assembled by inserting piston 80 and spring 82 into the bore 84. A cap 108 is then screwed onto the valve 78 to retain the internal parts.

The remaining elements shown in FIG. 3 include a manifold 110 and manifold gasket 112. The manifold 110 provides the flow paths 48, 72 and 88 shown in FIG. 2 and illustrated in more detail in FIG. 6. The manifold gasket 112 provides a water tight seal between the pump body 92 and the manifold 110, while allowing fluid flow to and from the flow paths 48, 72 and 88. In this embodiment, the manifold 110 is attached to the pump body 92 by twenty-five threaded fasteners 114 (only one illustrated), which pass through the manifold 110 and gasket 112 and are threaded into tapped holes in the pump body 92. It is believed that the number of fasteners 114 can be reduced as various modifications in structures and materials are tested.

Figure 4:
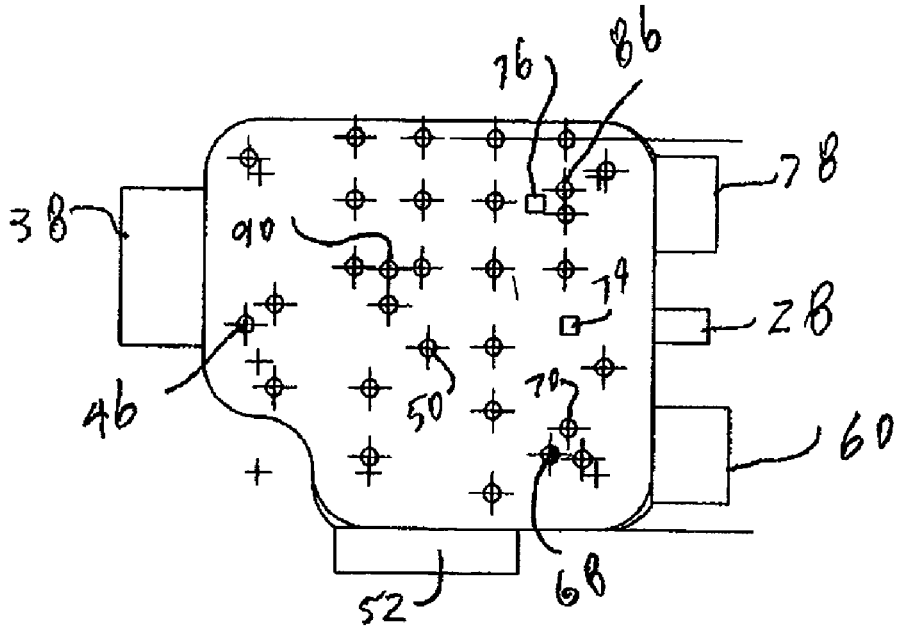
FIG. 4 is a front view of the pump body of the FIG. 3 embodiment.
Figure 5:
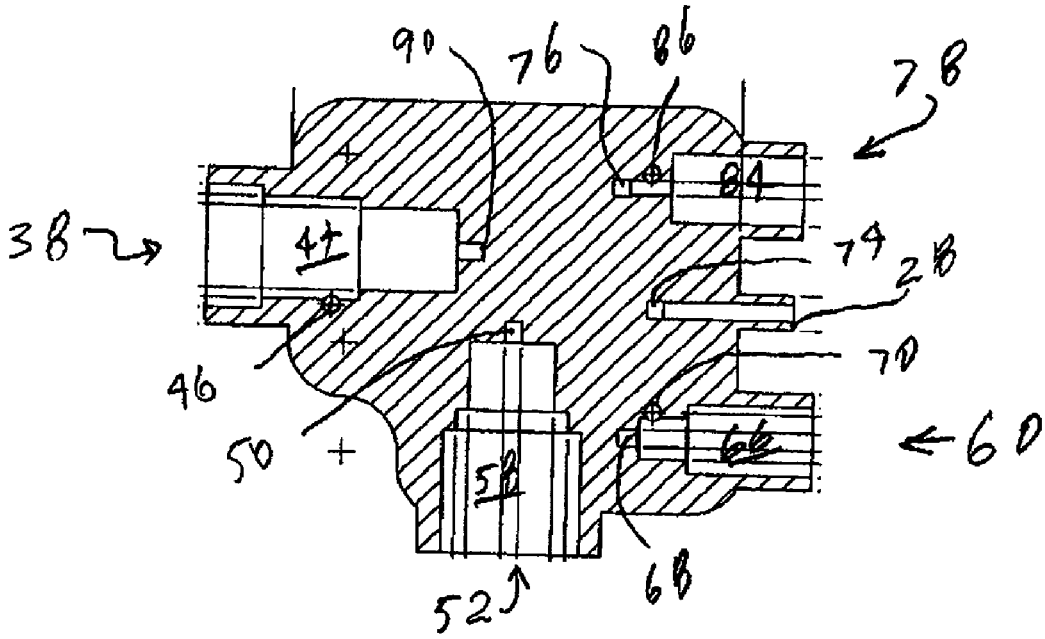
FIG. 5 is a cross-sectional view of the pump body of the FIG. 3 embodiment.

FIG. 4 is a plan view of the pump body 92 and FIG. 5 is a cross sectional view through the pump body 92. In these figures, the inlets and outlets of the pump 52 and valves 38, 60 and 78 are labeled with the same reference numbers used in FIG. 2. The remaining bores shown in FIG. 4 are threaded holes for receiving the threaded fasteners 114 which attach the manifold 110 and gasket 112 to the pump body 92. As shown in these figures, the inlets and outlets extend from the bores in the pump body 92 to the surface shown in FIG. 4. The gasket 112 has corresponding openings to accommodate the fasteners 114 and to allow fluid to flow between the pump body 92 to the manifold 110, i.e. the gasket 112 has a shape and pattern of openings essentially identical to the face of pump body 92.

Figure 6:
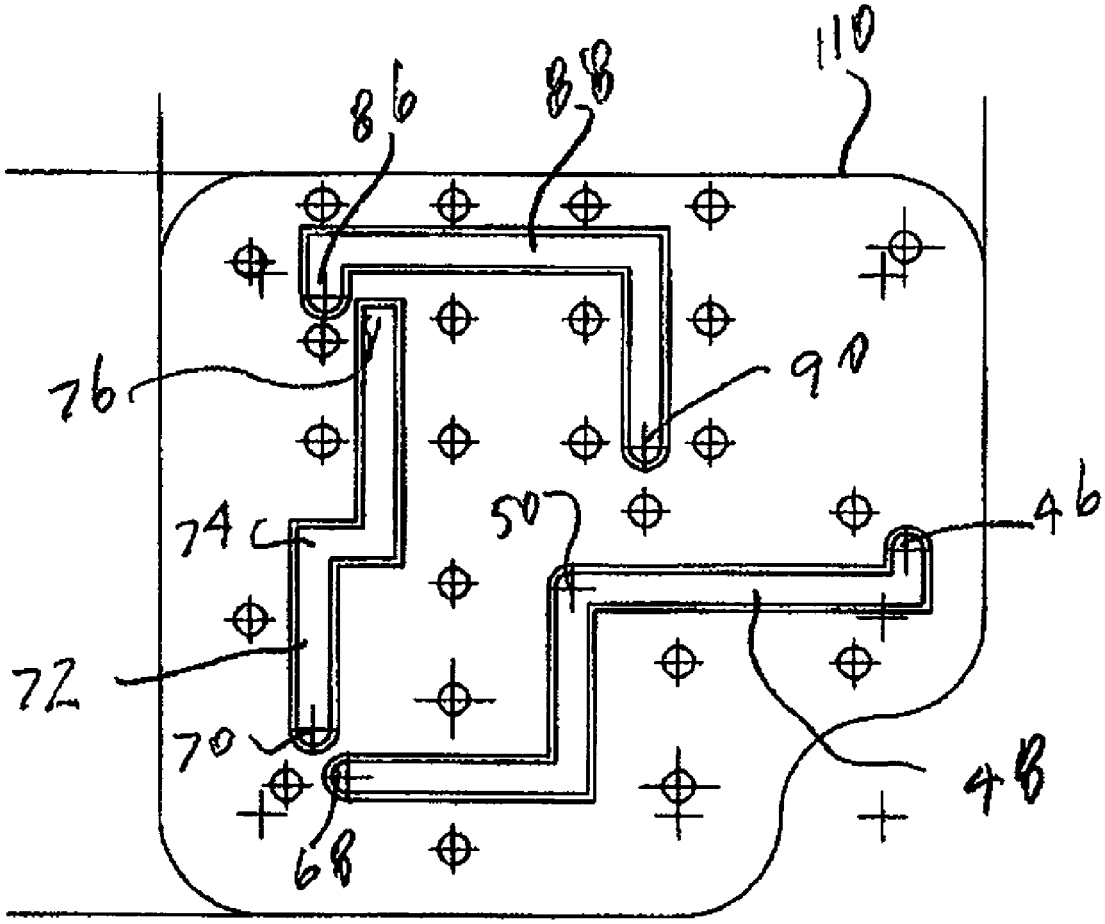
FIG. 6 is a plan view of a manifold forming part of the FIG. 3 embodiment.

FIG. 6 is a plan view of the side of manifold 110 which faces the gasket 112 and pump body 92 when the pump 24 is assembled as shown in FIG. 3. The manifold 110 provides three fluid paths for connecting the various inlets and outlets shown in FIGS. 2 through 5. Flow path 48 connects the outlet 46 of the inlet valve 38, the inlet/outlet 50 of pump 52, and the inlet 68 to middle pressure valve 60. Flow path 74 connects the outlet 72 of middle pressure valve 60, the outlet 74, and the inlet 76 of high pressure valve 78. The flow path 88 connects the outlet 86 of high pressure valve 78 and the inlet 90 of the inlet valve 38.

Operation of the disclosed embodiment begins with obtaining an essentially conventional electric fan. It may be desirable to provide a slightly longer motor shaft 12 than is required for a conventional electric fan without a mister system. The eccentric 34 and bearing 36 are mounted on the fan shaft 12 between the motor 10 and fan blades 14 as shown in FIG. 1. The eccentric is fixed to the shaft 12 so that it rotates with the shaft 12. A pump 24 is then assembled as described above with reference to FIG. 3 and mounted on fan frame 20 in a position in which pump shaft 32 rides on the bearing 36 and eccentric 34 so that it reciprocates when the shaft 12 rotates. One or more mister nozzles are mounted on the fan guard 18 and connected to the pump 24 high pressure outlet 28 by the flow line 29. A supply of low pressure water is then connected to the inlet 26 of pump 24.

No inlet cutoff or valve is needed in this embodiment, although one may be added if desired. The low pressure inlet valve 38 remains closed until a supply of water with over about 20 psi is attached and the pressure opens the valve 38. When the fan is not running and therefore the pump 52 is not pumping, the pressure on the inlet 68 of middle pressure valve 60 will be no more than the pressure at inlet 26. The middle pressure valve 60 is designed with an opening pressure of about 120 psi, which exceeds the pressure of essentially all conventional water supplies. Therefore, inlet water will not pass through the middle pressure valve 60 when the fan is not running. This arrangement obviates the need for manual or electrical inlet cutoff valves often used in conventional mister systems.

When the fan motor 10 is turned on, the shaft 12 rotates the eccentric 34 and bearing 36 and thereby moves the pump shaft 32 up and down. If the motor 10 is a multispeed motor, the rate of pumping increases with the speed of fan blades 14. As the pump piston 54 moves downward, it draws water from flow path 48 into the pump bore 58. As piston 54 draws water from the flow path 48, the pressure on the spring side of piston 40 drops and the supply water pressure opens the inlet valve, allowing inlet water to flow into the pump 52. As the pump piston 54 moves upward, it pumps the water out the outlet 50 into flow path 48. When the pressure in flow path 48 plus the force of spring 42 exceeds the force provided by the inlet water supply 26, the piston 40 closes the inlet water supply. When the pressure in flow path 48 exceeds about 120 pounds, the piston in middle valve 60 opens the outlet 70 and allows water to flow into the flow path 72, and therefore to the outlet 28.

The pump 52 is capable of producing water pressure in excess of the design value of 1000 psi. The flow path 72 is also connected to the inlet 76 of the high pressure valve 78. When pressure in flow path 72 reaches about 1000 psi, the piston 80 compresses spring 82 and opens the outlet 86, allowing water to flow into the flow path 88. The flow path 88 is connected to the second inlet 90 of inlet valve 38. This pressure also urges the inlet valve piston 40 to the left, keeping the inlet 26 closed. When inlet valve piston 40 closes the inlet 26, it also places the outlet 46 in communication with the inlet 90 and allows the excess water from high pressure relief valve 78 to be recycled back to pump 52 through flow path 48 for the next stroke of the pump 52.

The pump 24 maintains a substantially constant pressure of about 1000 psi at the nozzles 30 and efficiently atomizes water to provide for nearly instant vaporization and cooling. If the fan has a multispeed motor, the pump will reciprocate faster at higher fan speeds and could be expected to increase flow and pressure, but the pressure relief system maintains an essentially constant pressure at the nozzles 30 for optimum performance.

In this embodiment, the pump body 92 and manifold 110 may be die cast from a metal glass nylon. The gasket 112 may be made of Neoprene rubber. The inlet valve 38 piston 40 and bushing 94, the pump piston and shaft 54, 32, the middle pressure valve piston 62, and the high pressure valve piston 80 may be cast from Teflon mineral filled Acetel. The pump seal bushing 102 may be made of Teflon and stainless steel. The valve springs 42, 64 and 82 may all be stainless steel springs and may all be the same size and have the same spring constant, e.g. 8.3 pounds per inch. The pressure values of the valves may be set by appropriate selection of the diameters of the pistons 40, 62 and 80. The pump spring 56 may also be made of stainless steel and may also have a spring constant of 8.3 pounds per inch. The valve and pump caps 98, 105, 106 and 108 may be made of metal, e.g. brass, and are preferably nickel or chrome plated for corrosion resistance and appearance purposes. The threaded fasteners 114 may be made of stainless steel. The pump body 92 and other plastic parts could be molded or machined from other engineered plastics for improved strength, corrosion resistance, and self lubricating properties. The pump body 92 and other plastic parts could be molded or machined from suitable metal, e.g. aluminum, brass or steel if desired. In this embodiment, the parts are made of high strength plastic which does not corrode, is self lubricating, and can be conveniently injection molded for economical mass production.

In this embodiment, the pump body 92 has dimensions of about three inches by 3.25 inches by about 1.50 inches thick. The pump 24 is less than two inches thick with the manifold 110 and gasket 112 assembled. It is considerably smaller and lighter than prior art high pressure mister pumps. The small size and light weight make it practical to install the pump 24 on conventional fans with little modification.

In testing of a mister fan system according to this embodiment, it has been found that substantially all water droplets evaporate within about twenty-four inches of the nozzles 30 at reasonable humidity levels. This can be determined by placing a hand in the air stream from the fan and moving toward the fan until moisture can be felt. This allows the mister system to be used indoors without danger of damaging indoor furniture, papers, etc. with water. The air stream is noticeably cooler than ambient air and has been measured to be twenty degrees F. or more cooler than ambient air. Both the distance required for complete evaporation and the amount of cooling are affected by the relative humidity of ambient air.

Mister cooling systems rely on the evaporation of water to provide cooling. The system described herein is designed and intended primarily for providing pressurized water to mister nozzles. The water need not be pure water in the sense that it need not be distilled or de-ionized, but may include dissolved minerals normally found in clean tap water. If desired, a small percentage of water soluble or water miscible materials may be added to the water. For example, fragrances or insect repellant materials may be added to the water. It may be desirable to add a particulate filter on the input water line to avoid damage to the pump piston and valves, especially if the supply is from a source other than an approved municipal water system, e.g. from a private well.

While the present invention has been illustrated and described in terms of particular embodiments, it is apparent that various changes, additions and substitutions of equivalent parts and materials may be made without departing from the scope of the invention as defined by the appended claims.

I claim:

1. A flash evaporation cooling system, comprising:

a conventional fan of the type having a power source, a frame and having fan blades carried on a rotatable shaft of a motor;

an eccentric attached to the rotatable shaft, wherein the eccentric rotates as the shaft rotates;

a fluid loop including a water pump, a water pump high pressure water outlet, at least one mister nozzle, a high pressure relief valve for receiving recycled water from the at least one mister nozzle and an inlet pressure relief valve said water pump mounted on the frame in proximity to the rotatable shaft and comprising a pump body housing a pump bore, a pump piston and a spring carried within the bore, a seal between the pump piston and the bore, and a pump piston shaft extending from the bore and exiting externally from the pump body, wherein the externally protruding aspect of the pump piston shaft is in continuous contact against a bearing on the outer surface of the eccentric, the pump shaft and piston reciprocating in an eccentric manner as the fan shaft rotates, and wherein said pump body further comprises a water inlet/outlet, wherein the water inlet/outlet pressure and the spring provide force to hold the piston against the bearing on the down stroke;

said at least one mister nozzle coupled to the water pump high pressure water outlet, and positioned to emit atomized water mist near the fan blades;

said inlet pressure relief valve in the pump body having a first water inlet in communication with a water supply, a second inlet in communication with the high pressure relief valve and a water outlet in fluid communication with the pump bore to supply the pump with water and to recycle excess water back to the pump.

2. The cooling system of claim 1, the inlet pressure relief valve comprising:

an inlet valve piston, an inlet valve spring, the piston and spring selected to close the water outlet when pressure across the piston is less than a first preselected value and to open the water outlet when pressure across the piston is more than the first preselected value.

3. The cooling system of claim 2, further comprising:

a middle pressure relief valve in the pump body having a middle valve inlet in fluid communication with the pump bore, having a middle valve piston, a middle valve spring, and a middle valve outlet, the piston and spring selected to close the middle valve outlet when pressure across the piston is less than a second preselected value, the second preselected value being greater than the first preselected value, and to open the middle valve outlet when pressure across the piston is more than the second preselected value, the middle valve outlet in fluid communication with the water pump high pressure water outlet and the high pressure relief valve.

4. The cooling system of claim 3, further comprising:

the high pressure relief valve in the pump body having a high pressure valve inlet in fluid communication with the water pump high pressure water outlet, having a high pressure valve piston, a high pressure valve spring, and a high pressure valve outlet, the piston and spring selected to close the high pressure valve outlet when pressure across the piston is less than a third preselected value, the third preselected value being greater than the second preselected value, and to open the high pressure valve outlet when pressure across the piston is more than the third preselected value, the high pressure valve outlet in fluid communication with the inlet pressure relief valve.

5. The cooling system of claim 4, wherein:

the first preselected value is about twenty pounds per square inch, the second preselected value is about one hundred twenty pounds per square inch, and the third preselected value is from about eight hundred to about fifteen hundred pounds per square inch.

6. The cooling system of claim 4, wherein:

the third preselected value is about one thousand pounds per square inch.

7. A flash evaporation mister kit for installation on a conventional fan wherein the fan has a power source, a motor, a rotatable motor shaft, and fan blades, and wherein the kit comprises:

an eccentric adapted for mounting on the motor shaft;

a fluid loop including a water pump, a water pump high pressure water outlet, at least one mister nozzle, a high pressure relief valve for receiving recycled water from the at least one mister nozzle and an inlet pressure relief valve said water pump comprising a pump body housing a pump bore, a pump piston and a spring carried within the bore, a seal between the pump piston and the bore, and a pump piston shaft extending from the bore and exiting externally from the pump body, wherein the externally protruding aspect of the pump piston shaft is in continuous contact against a bearing on the outer surface of the eccentric, the pump shaft and piston reciprocating in an eccentric manner as the fan shaft rotates, and wherein said pump body further comprises at least one water inlet/outlet wherein the at least one water inlet/outlet pressure and the spring provide force to hold the piston against the bearing on the down stroke;

said at least one mister nozzle coupled to the water pump high pressure water outlet, and positioning to emit atomized water mist near the fan blade, and said inlet pressure relief valve in the pump body having a water inlet, an inlet valve piston, an inlet valve spring, and a water outlet, the piston and spring selected to close the water outlet when pressure across the piston is less than a first preselected value and to open the water outlet when pressure across the piston is more than the first preselected value, the water outlet in fluid communication with the pump bore, and a second inlet in fluid communication with the high pressure relief valve to recycle excess water back through the pump.

8. The cooling system of claim 7, further comprising:

a middle pressure relief valve in the pump body having a middle valve inlet in fluid communication with the pump bore, having a middle valve piston, a middle valve spring, and a middle valve outlet, the piston and spring selected to close the middle valve outlet when pressure across the piston is less than a second preselected value, the second preselected value being greater than the first preselected value, and to open the middle valve outlet when pressure across the piston is more than the second preselected value, the middle valve outlet in fluid communication with the water pump high pressure water outlet and the high pressure relief valve.

9. The cooling system of claim 8, further comprising:

the high pressure relief valve in the pump body having a high pressure valve inlet in fluid communication with the water pump high pressure water outlet, having a high pressure valve piston, a high pressure valve spring, and a high pressure valve outlet, the piston and spring selected to close the high pressure valve outlet when pressure across the piston is less than a third preselected value, the third preselected value being greater than the second preselected value, and to open the high pressure valve outlet when pressure across the piston is more than the third preselected value, the high pressure valve outlet in fluid communication with the inlet pressure relief valve.

10. A method for using low volumes of water to cool an indoor environment, the method comprising:

attaching an eccentric to a rotatable motor shaft on a conventional fan;

mounting a water pump on the fan in proximity to the motor shaft, the water pump comprising a pump body housing a pump bore, a pump piston and a spring carried within the bore, a seal between the pump piston and the bore, and a pump piston shaft extending from the bore and exiting externally from the pump body, wherein the externally protruding aspect of the pump piston shaft is in continuous contact against a bearing on the outer surface of the eccentric, the pump shaft and piston reciprocating in an eccentric movement as the fan shaft rotates, and wherein said pump body further comprises a water inlet/outlet in fluid communication with a water pump high pressure water outlet;

coupling at least one mister nozzle to the water pump high pressure water outlet, and positioning the at least one nozzle to emit atomized water mist near the fan blade, providing a high pressure relief valve in fluid connection to said at least one mister nozzle, and providing an inlet pressure relief valve in the pump body, the inlet pressure relief valve having a water inlet, an inlet valve piston, an inlet valve spring, and a water outlet, the piston and spring selected to close the water outlet when pressure across the piston is less than a first preselected value and to open the water outlet when pressure across the piston is more than the first preselected value, the water outlet in fluid communication with the pump bore, and a second inlet in fluid communication with the high pressure relief valve to recycle excess water back through the pump.

11. The method of claim 10, further comprising:

providing a middle pressure relief valve in the pump body having a middle valve inlet in fluid communication with the pump bore, having a middle valve piston, a middle valve spring, and a middle valve outlet, the piston and spring selected to close the middle valve outlet when pressure across the piston is less than a second preselected value, the second preselected value being greater than the first preselected value, and to open the middle valve outlet when pressure across the piston is more than the second preselected value, the middle valve outlet in fluid communication with the water pump high pressure water outlet and the high pressure relief valve.

* * * * *